US006109517A

United States Patent [19]

Cabrera

[11] Patent Number: 6,109,517

[45] Date of Patent: Aug. 29, 2000

[54] CONSTRUCTIVE ARRANGEMENT APPLIED TO AN OPENING DEVICE FOR PACKAGES

[76] Inventor: Persival Antonio Cabrera, Rua Jose dos Passos Bruques, No. 85, Sao Paulo - SP, Brazil

[21] Appl. No.: 08/778,107

[22] Filed: Jan. 2, 1997

[30] Foreign Application Priority Data

Jan. 4, 1996 [BR] Brazil ..... 7600558 U

[51] Int. Cl.[7] ..... B65D 5/70

[52] U.S. Cl. ..... 229/217; 229/219; 229/233

[58] Field of Search ..... 229/217, 219, 229/222, 233, 234

[56] References Cited

U.S. PATENT DOCUMENTS

| | | |
|---|---|---|
| 1,717,367 | 1/1929 | Byrne . |
| 2,002,485 | 5/1935 | Alfred . |
| 2,010,863 | 8/1935 | Johnson . |
| 3,147,905 | 9/1964 | Gill . |
| 3,270,941 | 9/1966 | Barnes . |
| 3,438,565 | 4/1969 | Lugt et al. . |
| 4,122,948 | 10/1978 | Grieve et al. . |

*Primary Examiner*—Gary E. Elkins

[57] ABSTRACT

The present invention refers to a constructive arrangement applied to an opening device for packages of the carton type, containing a dry product, either powdered or granulated, such as powdered soap or the like. The constructive arrangement includes a transversely semiarticulated tongue which has perforated lines. The tongue is defined by a semicircular area disposed in one of the side faces of the package and by a rectangular area disposed in the upper face thereof. An articulated rectangular flap is positioned on the portion which is disposed in the upper face and also has perforated lines. To open the package, these perforated lines are broken and the semiarticulated tongue and the rectangular flap are moved so as to be juxtaposed in the vertical position in the upper face of the package. In operation, the semiarticulated tongue is folded so that its semicircular and rectangular parts will be joined together in the vertical position.

7 Claims, 5 Drawing Sheets

CONSTRUCTIVE ARRANGEMENT APPLIED TO AN OPENING DEVICE FOR PACKAGES

SUMMARY OF THE INVENTION

The present invention relates to a constructive arrangement for a package and, more specifically, to a constructive arrangement applied to an opening device for carton-type packages containing a dry powdered or granulated product, such as powder soap. This opening device is usually employed to dispense a product from the box to a desired place, the present invention proposing a practical and functional opening device, which enables a facilitated initial breaking and a later utilization thereof as a sealing element of the opening produced. This constructivity is basically defined by using a transversely semiarticulated tongue, defined in the package by weakening lines, the semiarticulated tongue occupying a semicircular area in one of the side faces of the package and in the upper face thereof.

BRIEF DESCRIPTION OF THE DRAWINGS

For a better understanding of the present utility model, it will now be described with reference to the drawings, in which.

DETAILED DESCRIPTION

Figure 1:
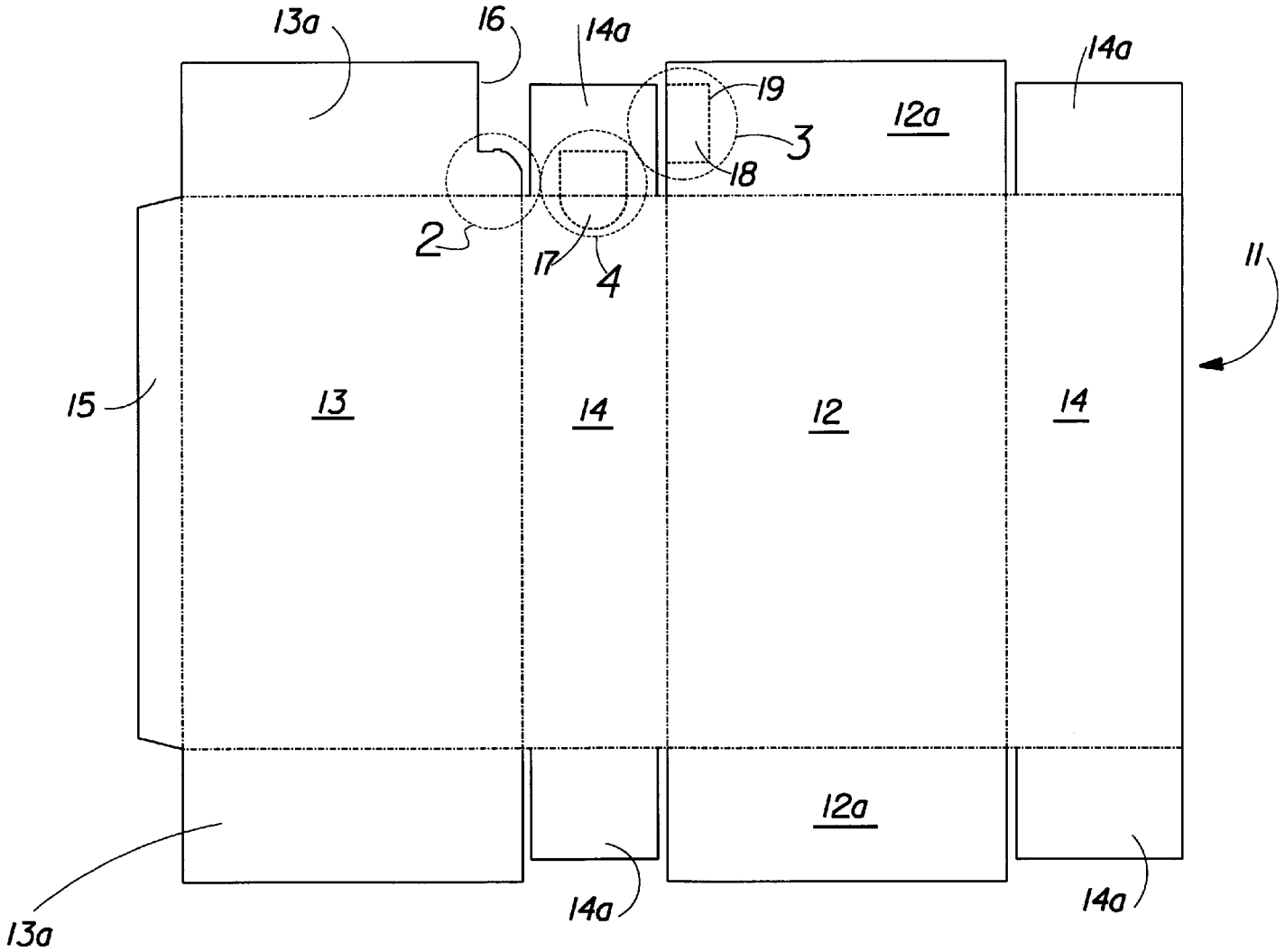
FIG. 1 is a planned view of the package provided with the constructive arrangement proposed.
Figure 2:
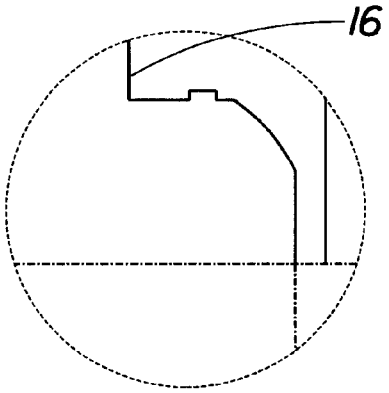
FIG. 2 is enlarged detail "A" of FIG. 1.
Figure 3:
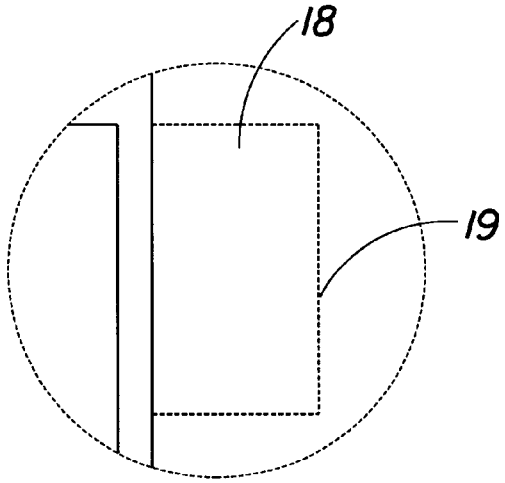
FIG. 3 is enlarged detail "B" of FIG. 1.
Figure 4:
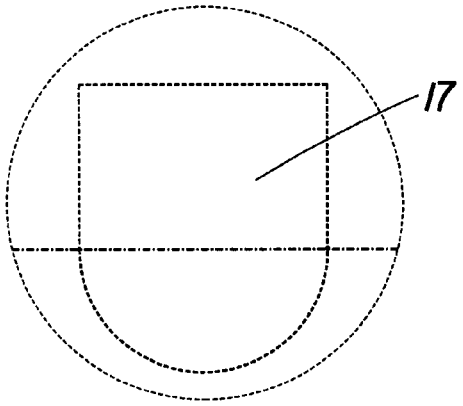
FIG. 4 is enlarged detail "C" of FIG. 1.
Figure 5:
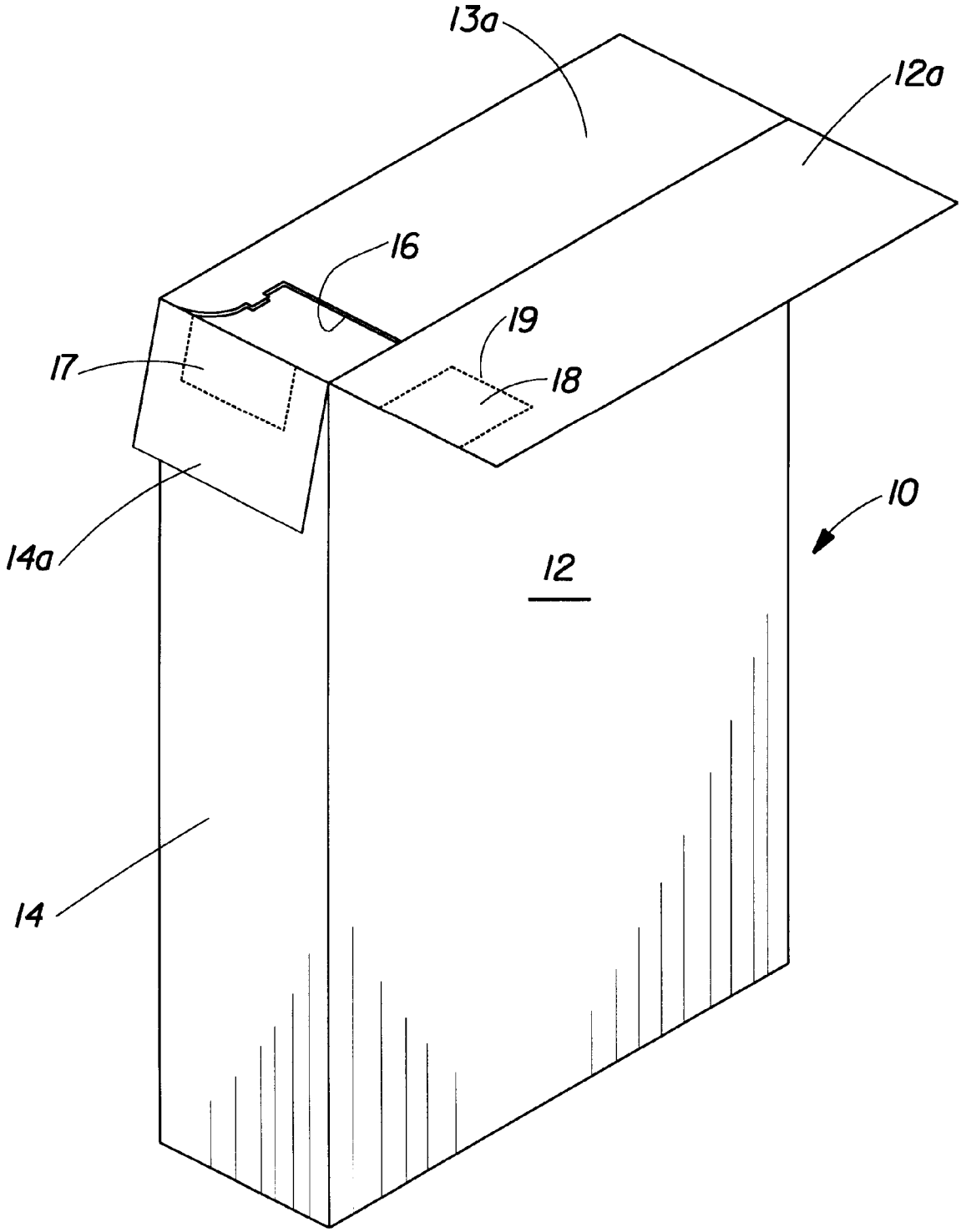
FIG. 5 is a perspective of the package in a preassembly stage illustrating the device proposed.
Figure 6:
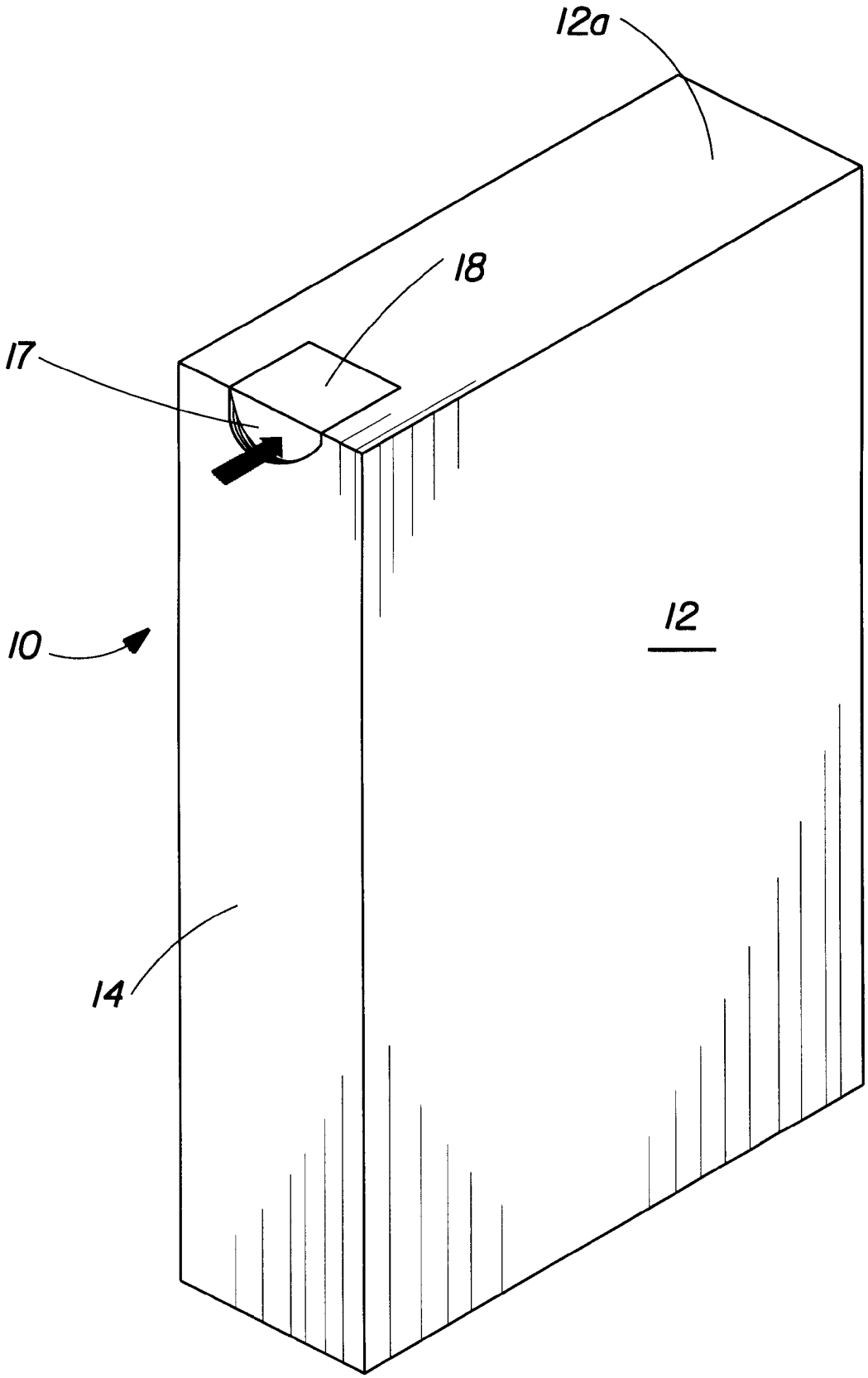
FIG. 6 is a perspective of the assembled package illustrating the proposed device in its first opening stage.
Figure 7:
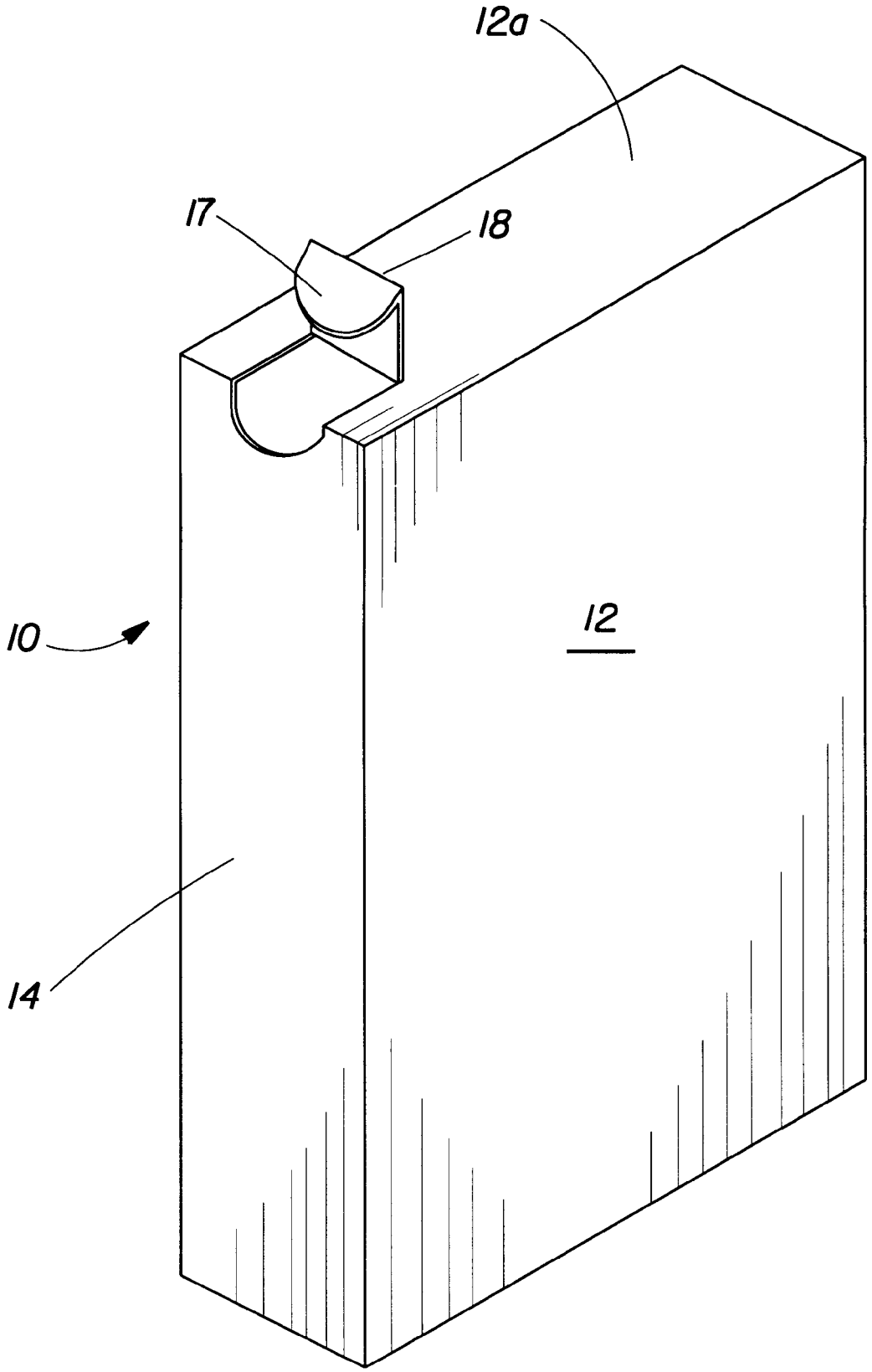
FIG. 7 is a perspective of the assembled package illustrating the proposed device in its second opening stage.

A carton-type package (10), intended to contain dry powdered or granulated products, such as soap powder, is obtained from a single rectangular sheet (11), cut out and creased so as to define a pair of larger and identical rectangular areas constitute the front (12) and back (13) faces of the package. A pair of smaller and identical rectangular areas constitutes the side faces (14) of the package, one of the latter being disposed between said larger and identical rectangular areas, and the other being disposed at the outer side of one of these same rectangular and identical areas. A trapezoidal flap (15) is joined to the outer side of the other larger rectangular area. Each smaller side of the front (12) and back (13) faces and each smaller side of the side faces (14) is provided with a respective rectangular prolongation **(12*a*), (13*a*) and (14*a*)** defining the upper and lower faces of the package.

The constructive arrangement comprises an L-shaped cut-out (16) made in an innermost edge of the rectangular prolongation **(13*a*) of the back face (13). The smaller and horizontal leg is defined by a rectangular segment, followed by a rectangular step and complemented outwardly by an arc which ends close to a vertex of the rectangular prolongation (14*a*) of the corresponding side face (14). The latter prolongation (14*a*) incorporates a semiarticulated tongue (17) defined by a rectangular area disposed in the rectangular prolongation (14*a*) which extends to the side face (14) in the form of a semicircle. The semiarticulated tongue (17) has perforated lines disposed in its larger sides and in its semicircular portion, defining a weakened area to be broken later, when the product is to be used. The tongue (17) is articulated by its horizontal smaller side. The rectangular prolongation (12*a*) corresponding to the back face (12) is provided with a small rectangular flap (18), defined by a rectangular area disposed from an edge of the smaller side of the prolongation (12*a*), adjacent the rectangular prolongation (14*a*) which contains the semiarticulated tongue (17). The smaller sides are disposed horizontally and provided with perforated lines, while the rectangular flaps (18) internal and vertical larger side has a central articulation point (19) and the flap's (18)**, other larger side is free for movement.

The assembling of the carton-type package (10) occurs in a usually known manner, by folding its constituent parts by means of its creasing lines and the gluing. In the assembled position, the L-shaped cut-out (16) of the rectangular prolongation **(13*a*) of the back face (13) is positioned under the rectangular area of the semiarticulated tongue, while the small rectangular flap (18) is positioned on this same rectangular area. The opening of the package occurs by breaking the perforated lines of the semiarticulated tongue (17) and of the small rectangular flap (18), the latter remaining positioned vertically close to the semiarticulated tongue (17), which in the operation is folded so that its rectangular and semicircular parts are joined in the vertical position. The semiarticulated tongue (17) and small rectangular flap (18)** then returns to its initial position, functioning as sealing elements of the opening produced in the package in use.

What is claimed is:

1. A constructive arrangement used for an opening device for a package, of the carton type, obtained from a single sheet, cut out and creased so as to define a plurality of areas, comprising:

a front face of the package having an outer side;

a back face of the package having an outer side;

a pair of side faces of the package, one of said side faces being disposed between said front and back faces, and the other of said side faces being disposed on said outer side of said front face;

a trapezoidal flap being joined to said outer side of said back face;

a prolongation attached to each smaller side of said front and back faces, and each smaller side of said side faces is provided with a respective prolongation, said prolongations defining upper and lower faces of the package;

an L-shaped cut-out made in an innermost edge of said prolongation of said back face, a smaller and horizontal leg of which is defined by a small segment, followed by a small arc which ends close to a vertex of said prolongation of said corresponding side face;

a semiarticulated tongue positioned on said prolongation of said corresponding side face and defined by a rectangular area disposed in said prolongation, which extends to said side face in the form of a semicircle portion, said rectangular area having a pair of larger sides vertically disposed and a smaller side horizontally disposed, said semiarticulated tongue having perforated lines disposed at the larger sides and at said semicircular portion, defining a weakened area, said tongue being articulated through its horizontal smaller side; and a small flap defined by an area disposed from an edge of a smaller side of said prolongation of said front face, adjacent said prolongation, which contains said semiarticulated tongue, said smaller sides of said area being disposed horizontally and provided with perforated lines, while said internal vertical larger side of said area has a central articulation point and said other external larger side of said area is free for movement.

2. The constructive arrangement of claim 1, wherein said front and back faces are identical in size.

3. The constructive arrangement of claim 1, wherein said front and back faces are rectangular in shape.

4. The constructive arrangement of claim 1, wherein said side faces are identical in size.

5. The constructive arrangement of claim 1, wherein said side faces are rectangular in shape.

6. The constructive arrangement of claim 5, wherein said side faces are smaller in size relative to said front and back faces.

7. The constructive arrangement of claim 1, wherein at least one of said prolongation, said segment, said flap, and said area is rectangular in shape.

* * * * *